United States Patent [19]

Catanese

[11] 4,164,681

[45] Aug. 14, 1979

[54] IMAGE DISPLAY DEVICE WITH ION FEEDBACK CONTROL AND METHOD OF OPERATING THE SAME

[75] Inventor: Carmen A. Catanese, Rocky Hill, N.J.

[73] Assignee: RCA Corporation, New York, N.Y.

[21] Appl. No.: 750,402

[22] Filed: Dec. 14, 1976

[51] Int. Cl.[2] ..... H01J 31/00; H01J 43/00

[52] U.S. Cl. ..... 313/400; 315/366

[58] Field of Search ..... 313/105 R, 400, 422

[56] References Cited

U.S. PATENT DOCUMENTS

| | | | |
|---|---|---|---|
| 3,904,923 | 9/1975 | Schwartz | 313/103 R X |
| 4,001,620 | 1/1977 | Endriz | 313/400 |
| 4,051,468 | 9/1977 | Rajchman | 250/213 VT X |

*Primary Examiner*—R. Segal

*Attorney, Agent, or Firm*—Eugene M. Whitacre; Glenn H. Bruestle; Vincent J. Coughlin, Jr.

[57] ABSTRACT

A cathode device which employs regenerative ion feedback for sustained electron emission includes an enclosure filled with inert gas. A cathode, an electron multiplier region, and an ion interaction region are disposed in consecutive order within the enclosure with the interaction region being positioned at the output of the electron multiplier region. Means are provided for controlling the magnitude of ion feedback to the cathode whereby the feedback loop gain of the device can be caused to be either greater than, or less than, unity. The cathode device is useful in a cathodoluminescent cell which further includes an electron accelerating region and a cathodoluminescent screen. A plurality of these cathodoluminescent cells can be arranged so as to constitute an image display device. Disclosed also is a method of operating the cathode device and image display device.

18 Claims, 5 Drawing Figures

IMAGE DISPLAY DEVICE WITH ION FEEDBACK CONTROL AND METHOD OF OPERATING THE SAME

BACKGROUND OF THE INVENTION

This invention relates to devices which employ regenerative ion feedback for sustained electron emission, and particularly to structures and methods for controlling the output of such devices.

Display devices have been proposed in which electron multipliers operated in a regenerative ion feedback mode are used to provide current to light up a cathodoluminescent screen. For example, see U.S. Pat. No. 3,904,923 entitled "CATHODOLUMINESCENT DISPLAY PANEL," issued Sept. 9, 1975 to J. Schwartz. In one such structure, the electron multiplier includes at least two vanes having a plurality of parallel dynodes disposed in staggered relation thereon with a cathode at one end. This structure is further described in copending application Ser. No. 672,122, filed Mar. 31, 1976, entitled, "PARALLEL VANE STRUCTURE FOR A FLAT DISPLAY DEVICE." In this structure, electrical potentials of increasing magnitude are provided to the successive multiplying dynodes so as to produce an electron beam at the multiplier output. Generally, the electron multiplier has an open structure to allow feedback of ions which results in sufficiently high loop gain to produce sustained electron emission.

In one form of the previously described display device, display modulation is achieved by placing the necessary electrical potential on electrodes which are disposed near the multiplier output at a point between the multiplier and the cathodoluminescent screen. One problem with such a structure is that the electron multiplier must include filter structure to prevent high energy electrons from reaching the multiplier output. Otherwise, these high energy electrons would require extremely high voltages for acceptable modulation. Thus, it would be desirable to develop a structure and method for modulating a display device which employs regenerative ion feedback.

SUMMARY OF THE INVENTION

A cathode device employs regenerative ion feedback and includes an enclosure filled with inert gas. A cathode and electron multiplier are included in the enclosure with the electron multiplier being disposed to one side of the cathode. An ion interaction region is in the enclosure and is positioned to one side of the multiplier to receive the electron output therefrom. Means are provided for controlling the magnitude of ion feedback to the cathode.

DETAILED DESCRIPTION OF THE INVENTION

Figure 1:
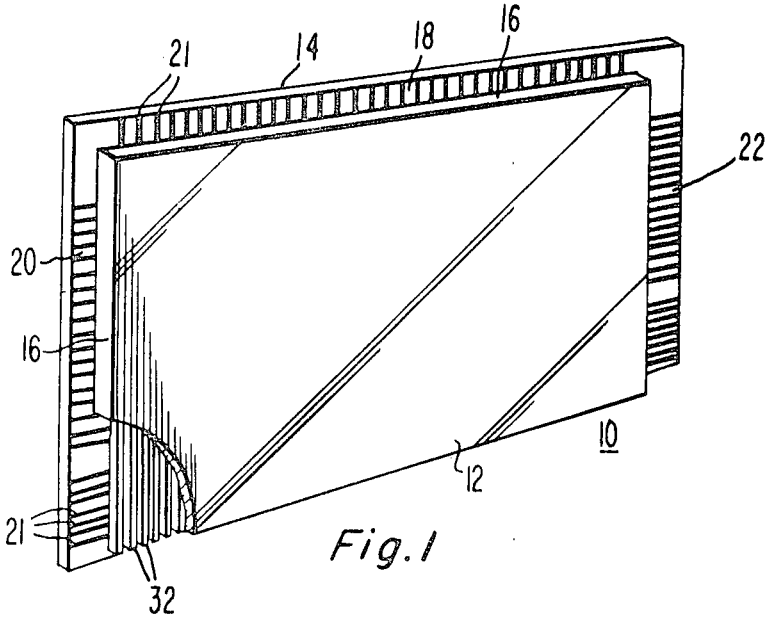
FIG. 1 is a partially cut-away perspective view of an image display device of the present invention.

Referring initially to FIG. 1, one form of an image display device 10 of the present invention includes an evacuated glass envelope having a flat transparent viewing front panel 12 and a flat back panel 14. The envelope is filled with an inert gas, e.g., argon or helium, to a low pressure, e.g., $10^{-3}$ torr. The front and back panels 12 and 14 are parallel and sealed together by peripheral side walls 16. The back panel 14 extends beyond the side walls 16 of the device 10 to form terminal areas 18, 20 and 22. Each of the terminal areas has a plurality of leads 21 which interconnect to internal components for activating and controlling the device.

Figure 2:
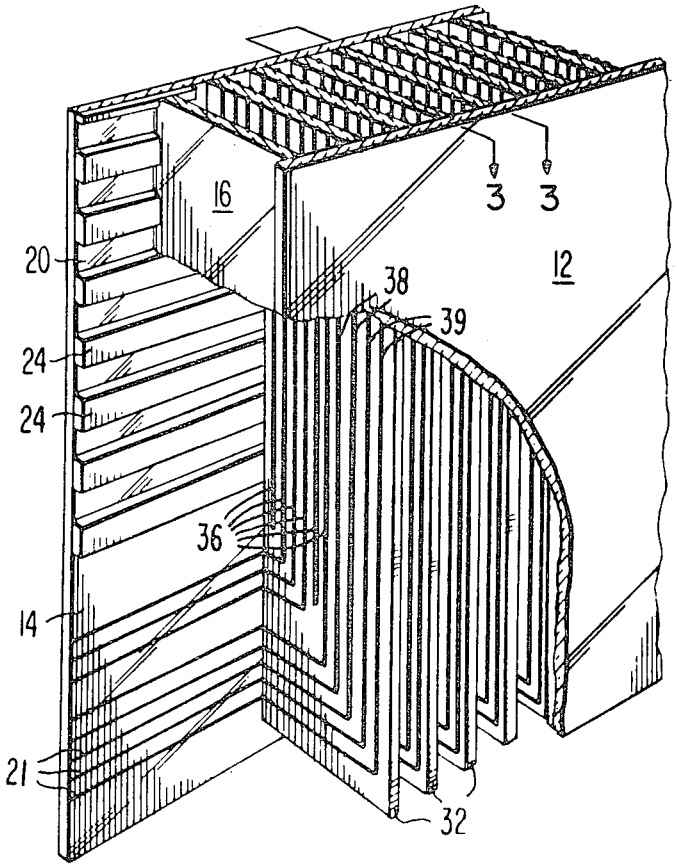
FIG. 2 is an enlargement of the cut-away section of FIG. 1.

The internal structure of the device 10 is shown in the cut-away view of FIG. 2. The back panel 14 has a plurality of cathode stripes 24 on its inside surface. Each stripe 24 is of a conductive material, such as metal, which may be overcoated with a thin layer of a material that provides a high electron emission under bombardment by a feedback species, such as ions. For example, the emissive material may be MgO or BeO. The cathode stripes 24 can be coated onto the back panel in the desired pattern by a variety of techniques, e.g., sputtering or evaporation of the component metal followed by photo-etching and oxidation. A plurality of spaced parallel vanes 32 extend between and are in perpendicular contact with the front and back panels 12 and 14. The vanes 32 are arranged orthogonal to the cathode stripes 24. Intrasupport of the front and back panels 12 and 14 is provided by the vanes 32. Each of the vanes 32 is formed from flat insulating material, such as glass or ceramic.

Each vane 32 includes on each of its major surfaces a plurality of spaced electron multiplier dynodes 36 and a plurality of spaced electrodes 38 and 39 for accelerating, modulating, and focusing electron beams. Both the dynodes 36 and the electrodes 38 and 39 may be formed as stripes running orthogonally with respect to the cathode stripes 24. The dynodes 36 and electrodes 38 and 39 can be constructed through large area processing techniques. A preferred construction technique includes bonding a foil to the vane 32 through the application of heat, an electric field, and pressure. The foil should be of a material which can be activated to have a high secondary emission coefficient ($\delta$). One suitable foil material is an alloy of magnesium and aluminum. The desired pattern, including the dynodes 36 and electrodes 38 and 39, can be defined in the foil either before or after bonding. This construction technique is more fully disclosed in copending patent application, Ser. No. 681,695, entitled, "Method of Forming Dynodes," filed Apr. 29, 1976.

The front panel 12 is preferably of glass and serves as the viewing faceplate of the device 10. The internal surface of the front panel 12 is covered with a plurality of phosphor stripes (not shown) which are capable of emitting light upon electron bombardment. The phosphor stripes are orthogonal to the cathode stripes 24 on the back panel 14. Each phosphor stripe extends parallel to and is disposed between each set of adjacent vanes 32. If the device 10 is intended to display a color image, the internal surface of the faceplate 12 may be covered with alternating red, green, and blue light emitting phosphor stripes.

Figure 3:
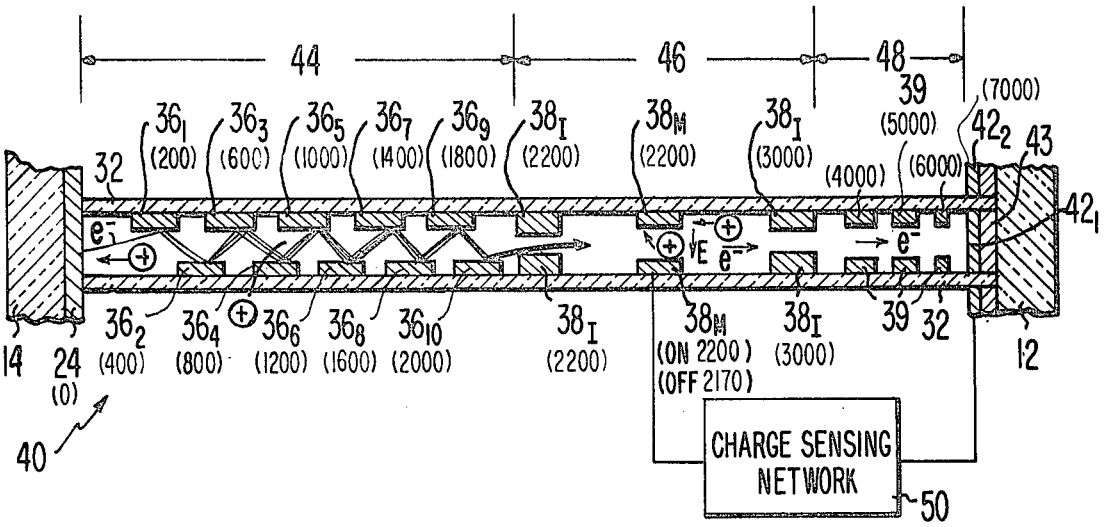
FIG. 3 is an enlarged diagrammatic view of a portion of the section shown in FIG. 2, taken along line 3—3, showing a cathodoluminescent cell of the present invention.

Referring now to FIGS. 2 and 3, the image display device 10 will now be further described by focusing on one cathodoluminescent cell 40 since the image display device actually comprises a plurality of such cathodoluminescent cells. The cathodoluminescent cell 40, or cold cathode device, is defined by an enclosure which is sealed by a pair of adjacent vanes 32 and by the front and back panels 12 and 14, respectively. Note that the back panel 14 includes the cathode 24 and the front panel 12 includes a conventional conductor layer 42, e.g., aluminum, and a cathodoluminescent screen layer 43. The cathodoluminescent cell 40 includes three regions: an electron multiplier region 44; an ion interaction region 46; and an electron accelerating region 48. It is desirable that the accelerating region 48 be of the same order of length, or shorter, as compared to the ion interaction region 46.

In the electron multiplier region 44, the dynodes $36_{1 \ldots 10}$ on the surfaces of the vanes 32 which face each other are disposed in staggered relation with the dynodes $36_{1 \ldots 10}$ being in parallel relation lengthwise. The ion interaction region 46 is disposed between the multiplier and accelerating regions 44 and 48 at the output of the electron multiplier region 44. That is, the ion interaction region 46 is positioned to receive the electron output from the dynode $36_{10}$ which is furthest from the cathode 24. The ion interaction 46 is further defined by isolation electrodes $38_I$ which form interfaces between the multiplier and accelerating regions 44 and 48 respectively. The isolation electrodes $38_I$ may protrude slightly from the vanes 32 with respect to other electrodes in the cell 40 so as to more easily accomplish the function of providing substantial electrical isolation from the multiplier and accelerating regions 44 and 48 respectively. Ion feedback modulating electrodes $38_m$ are disposed in the ion interaction region 46 with at least one being disposed on each vane 32. The modulating electrodes $38_m$ are in parallel relation to the dynodes 36. The accelerating region 48 includes accelerating electrodes 39 which are disposed on the vanes 32 in a fashion similar to the electrodes $38_m$.

Generally, in the operation of the display device 10, the cathode stripes 24 provide input electrons (e−) for the dynodes $36_{1 \ldots 10}$, as shown diagrammatically in FIG. 3. It should be noted that primary electrons are constantly being emitted from the cathode 24 due to cosmic or other external radiation impinging thereon. When the cathode stripe 24 is electrically more negative than the first dynode $36_1$, electrons emitted from the stripe 24 will be attracted thereto. This will initiate electron multiplication within the multiplier region 44. Some of these electrons form ions through collisions with the inert gas. Some of these positive ions strike the cathode 24 whereupon secondary electrons are released therefrom. Each of these factors contributes to the loop gain of the display device where the loop gain of the display device is defined as the average number of electrons ultimately released from the cathode in a complete cycle by the action of a single electron starting from the cathode. In the present case, the loop gain is thus equal to the product of the following:

1. the gain of the electron multiplier region 44;
2. the gas ionization probability due to a single output electron;
3. the probability that an ion generated in the ion interaction region 46 will feed back to the cathode 24; and
4. the secondary-electron-emission coefficient of the cathode 24 upon ion bombardment.

When the loop gain exceeds unity, the current in the loop builds up exponentially until some saturation effect, such as space charge, alters the electrical fields within the electron multiplier and reduces the gain to unity. The loop current then stabilizes at that level. If the loop gain is caused to fall below unity, the current exponentially falls towards zero.

In contrast to the structure and operating methods shown in previously mentioned U.S. Pat. No. 3,904,923 where the electron multiplier is switched on and off in order to control the loop gain, in one form of the present invention, loop gain is determined by controlling the magnitude of ion feedback to the cathode. This is accomplished by positioning the ion interaction region 46 in the volume within the cell 40 in which a significantly greater number of ions reach the cathode 24 than from any other region. Then, by establishing an electrical field in the ion interaction region 46 between the ion feedback modulating electrodes $38_m$, ion feedback can be reduced, or prevented, thus decreasing the loop gain.

In one form of the present invention, this ion feedback control is employed to cause loop gain to exceed unity during "on" operation and to be less than unity during "off" operation. For example, during "on" operation, "on" voltages are applied to the appropriate constituents of the cathodoluminescent cell 40; exemplary "on" voltages in volts are shown parenthetically in FIG. 3. When "off" time is desired, the appropriate electrical field (E) is established between the ion modulating electrodes $38_m$, thereby causing the loop gain to drop below unity due to the reduction in ion feedback. This terminates the current output of the cell 40. Note that control of ion feedback is optimized by the fact that the ion modulating electrodes $38_m$ are positioned to define a path therebetween which is transverse to the direction of ion feedback passing to the cathode 24. This transverse electrical field E between the ion feedback modulating electrodes $38_m$ which is required to terminate the cell output can be simply obtained by changing the voltage on one of the modulating electrodes, as shown parenthetically in FIG. 3.

In addition to the "on" and "off" states previously described, the display device of the present invention can be modulated so as to provide grey scale. For example, pulse width control is one convenient means to vary the amount of electrical charge which strikes the cathodoluminescent screen. In pulse width control, the "on" state time is varied in accordance with the desired charge variation. In this form of charge control, increasing the "on" time increases the amount of charge which strikes the screen. Conversely, decreasing the "on" time decreases the charge which strikes the screen. In one pulse width control scheme, the desired magnitude of electrical charge, i.e., brightness, is transferred to the screen by repeatedly oscillating between the "on" and "off" states. This can be accomplished by simply switching the voltage on one of the modulating electrodes $38_m$ between the "on" and "off" positions. This switching of voltage is done in accordance with information which is generally included in a brightness signal.

For a high degree of modulation, as well as good element-to-element uniformity, it may be desirable to include means for fine tuning the amount of charge which strikes the screen. One such means is the charge sensing network 50, shown in block form in FIG. 3.

Basically, the charge sensing network 50 allows only a predetermined amount of charge to strike the screen. This predetermined charge corresponds to the desired brightness level. After the predetermined charge strikes the screen, e.g., due to sufficient "on" time, the sensing network 50 terminates the output of the cell by switching the ion modulating electrode $38_m$ to the "off" voltage.

In one form, the sensing network 50 may include a plurality of charged capacitors which, after being discharged by the cell output, cause the desired switching to occur at the modulating electrodes $38_m$. These capacitors, i.e., brightness sensors, may be provided by segmenting the conducting layer 42 into conducting strips $42_{1 \ldots n}$, one of which is disposed between each adjacent pair of vanes 32. Each of the conducting strips $42_{1 \ldots n}$, exhibits a finite capacitance (C), where $V=Q/C$. Thus, charge incident on the conducting strip $42_1$ caused by the cell output will result in a voltage change ($\Delta V$) thereon. This voltage change corresponds to an electrical charge Q, where $Q=\Delta VC$. Thus, this voltage change is directly related to the screen brightness. Therefore, a high degree of modulating can be achieved by switching the ion feedback modulating electrode $38_m$ from "on" to "off" in accordance with a voltage change on each segmented strip $42_{l \ldots n}$ which corresponds to the desired screen brightness.

More specifically, the voltage change which corresponds to the screen brightness can be compared to the brightness signal by a voltage comparator. When a predetermined relationship between the two voltages, such as equality, has been reached, the comparator generates an output signal. This output signal is passed into a switching circuit. The switching circuit directs its output to switch the modulating electrode $38_m$ into "off" position so as to stop any further charge from reaching the screen, thereby ensuring the desired brightness. After the cathodoluminescent cell 40 has been switched off, it is reset for the next display. Resetting includes: establishing the desired initial voltage on the conductive strips 42; and readying the ion feedback modulating electrode $38_m$ for "on" operation. More information on this type of charge sensing can be found in copending application, Serial No. 709,411, filed July 28, 1976 entitled, "Apparatus and Method for Modulating a Flat Panel Display Device," now U.S. Pat. No. 4051,468 which issued on Sept. 27, 1977 to J. A. Raychman.

The cathodoluminescent cell 40 shown in FIG. 3 has several advantages when compared to previously known structures and operating methods. One advantage is that it operates primarily on the low energy ion beam so as to remove the control difficulties presented by the high energy tail of the typical secondary electron emission electron beam. Another advantage is that, during "on" time, the voltage changes are small and therefore result in only weak pertubations on the electron beam trajectories. Also, the small voltage changes permit simplified addressing circuitry. Another advantage is that the structure is relatively simple. Still further, it should be noted that, although the structure is open, there is no difficulty with highly energetic electrons which are created within the multiplier. This is due to the fact that no attempt is made to modulate these highly energetic electrons. Instead, modulation is more simply accomplished by causing the loop gain to decrease to below unity.

It should be noted that the previously described display device structure may be freely varied. For example, the number and shape of each of the constituents are exemplary only. Also, it is not necessary that the isolation electrodes $38_l$ protrude from the vanes 32 as long as the ion feedback modulating electrodes $38_m$ are electrically isolated from the multiplying and accelerating regions 44 and 48 respectively. This electrical isolation can also be provided by a relatively large spacing between the three regions within the display device. In the alternative, the necessary electrical isolation can be provided by applying a relatively large electrical voltage at the interfaces of the ion interaction region 46. Similarly, the charge sensing network 50 may also be varied. For example, other known modulation techniques can be used to switch the loop gain above and below unity in accordance with the image brightness signal.

Figure 4:
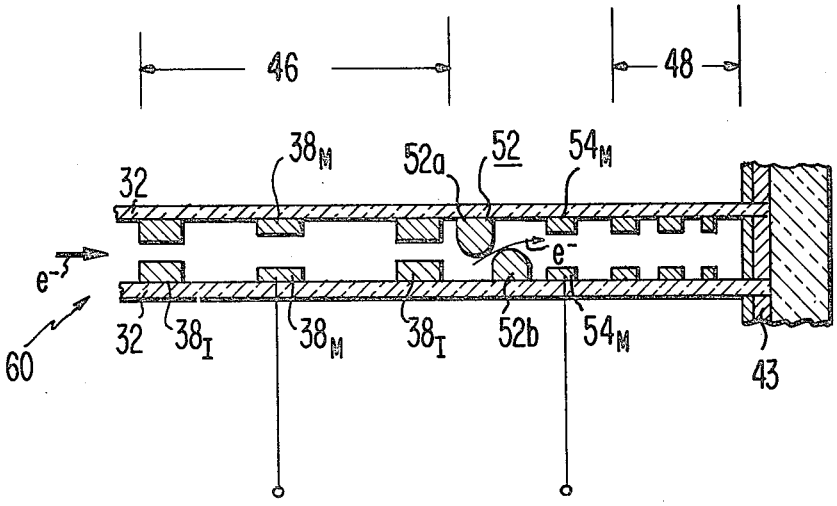
FIG. 4 is a sectional view, taken as in FIG. 3, showing a portion of a variation of the cathodoluminescent cell of the present invention.

One structural variation is partially shown in FIG. 4. The cathodoluminescent cell 60, or cold cathode device, is substantially the same as the cell 40 of FIG. 3 except that it includes a high energy filter 52 and a pair of electron modulating electrodes $54_m$. The electron filter 52 is positioned immediately following the ion interaction region 46 in the direction toward the screen 43. The electron filter includes two staggered bumps $52_a$ and $52_b$ which extend slightly more than half-way between the vanes 32. Each of the filter bumps includes a conductive surface. Additional information on such a filter can be found in copending application, Ser. No. 729,281; filed Oct. 4, 1976, entitled "Electron Multiplier with High Energy Electron Filter." The modulating electrodes $54_m$ are positioned on the vanes 32 outside of the ion interaction region so as to receive electrons which pass through the filter 52.

The operation of the cold cathode device 60 is as follows: Modulation is achieved through the application of appropriate voltages to the ion feedback modulating electrodes $38_m$ and also to the electron modulating electrodes $54_m$. This modulation is provided by applying a voltage signal to the ion feedback modulating electrode $38_m$ to cause the cold cathode device 60 to be on and a voltage signal to the electron modulating electrodes $54_m$ to provide grey scale. The voltage on the ion feedback modulating electrode $38_m$ functions to control the loop gain so that when "on" time is desired, the loop gain is caused to be greater than unity merely by allowing ions to feed back to the cathode 24, as previously described. In this embodiment, the voltage on the electron modulating electrodes $54_m$ functions to modulate "on" current. If desired, the voltage on the electron modulating electrodes $54_m$ can be electrically connected to the electrical charge deposited on the screen 43 via a charge sensing network (not specifically shown). It should be noted that, although the control of the cell 60 shown in FIG. 4 requires two levels of control, i.e., ion feedback and electron, it still provides advantages over prior art structure and control methods. One such advantage is that the loop gain control is accomplished at lower voltages as compared to loop gain control through control of the multiplier gain, as in the prior art.

General Considerations

Figure 5:
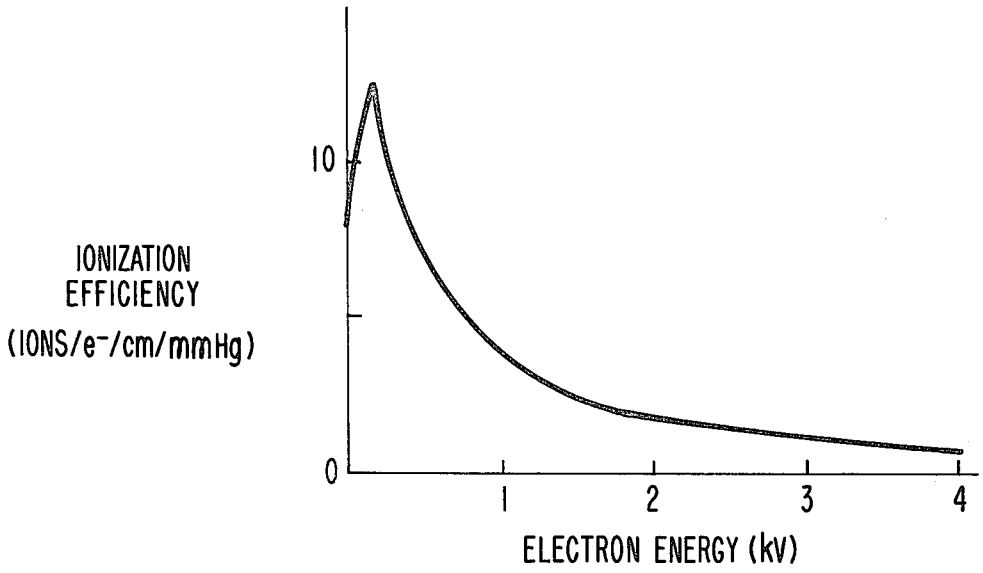
FIG. 5 is a graph showing the ionization efficiency of electrons in argon as a function of electron energy.

With regard to the proper dimensions and positioning of the ion interaction region and accompanying ion feedback modulating electrodes in the cathode and display devices of the present invention, I have found that, to optimize the control available in the ion interaction region, ion feedback from other regions should be minimized. In this regard, the following three considerations should be kept in mind:

(1) The efficiency with which electrons ionize a gas, e.g. argon, has a sharp peak at electron kinetic energies of 50–200 volts and falls off rapidly, as shown in FIG. 5. As a result, there is relatively little ionization in the acceleration region near the phosphor screen since electrons in this region typically have kinetic energies greatly in excess of 200 volts.

(2) A large percentage of the ions created within the multiplier region of an ion feedback device are swept aside by the strong transverse fields, and hence, do not feed back to the cathode. The exact percentage lost in this manner depends upon the particular multiplier geometry employed.

(3) The initial kinetic energy of an ion after ionization is a small fraction of an electron volt, i.e., less than 6.1 eV. Thus, it is possible to use relatively weak transverse electric fields within the ion interaction region to turn the feedback ion current on and off in order to modulate the output of the cathode and display device of the present invention.

With these three considerations in mind, as well as the knowledge of the operating voltages, one can then ascertain the most appropriate location of the ion interaction region and its accompanying ion modulating electrodes.

Thus, there is provided by the present invention, ion feedback cathode and display structures and operating methods therefor in which the difficulties of controlling high energy electrons is minimized. In addition, the cathode and display structure offer simplicity of circuitry as well as simplicity of structure.

I claim:

1. A cathode device employing regenerative ion feedback, which comprises:
(a) an enclosure filled with inert gas;
(b) a cathode in said enclosure;
(c) an electron multiplier region in said enclosure, said electron multiplier region disposed to one side of said cathode;
(d) an ion interaction region in said enclosure, said region being positioned to one side of said electron multiplier region to receive the electron ouput therefrom; and
(e) means for dynamically controlling the magnitude of ion feedback to said cathode.

2. A cathode device in accordance with claim 1 in which said ion interaction region is positioned in the volume in said enclosure wherein substantially all of the ions which feed back to said cathode are created.

3. A cathode device in accordance with claim 2 in which said means for controlling ion feedback to said cathode comprises ion feedback modulating electrodes which are disposed in said ion interaction region, at least two of said modulating electrodes being positioned so as to define a path therebetween which is transverse to the direction of ion feedback passing to said cathode.

4. A cathode device in accordance with claim 2 in which said means for controlling ion feedback to said cathode comprises ion feedback modulating electrodes which are disposed in said ion interaction region, at least two of said modulating electrodes being disposed in spaced relation so that an electrical field can be provided therebetween; and means for biasing said modulation electrodes.

5. A cathode device in accordance with claim 2 which further comprises:
an electron accelerating region disposed to one side of said ion interaction region, said accelerating region being positioned to receive the electron output of said multiplier region which passes through said ion interaction region; and
a cathodoluminescent screen disposed to one side of said accelerating region in the direction away from said cathode, said screen being positioned to receive the electron output of said accelerating region.

6. An image display device which includes a plurality of cathodoluminescent cells, each of the cells including an enclosure filled with inert gas, each of the cells comprising:
(a) a cathode device employing regenerative ion feedback, which includes:
(i) a cathode;
(ii) an electron multiplier region, said electron multiplier disposed to one side of said cathode;
(iii) an ion interaction region, said region being positioned to one side of said electron multiplier region to receive the electron output therefrom; and
(iv) means for controlling the magnitude of ion feedback to said cathode;
(v) ion feedback modulating electrodes disposed in said ion interaction region; and
(b) an electron accelerating region disposed to one side of said ion interaction region with said ion interaction region being positioned between said multiplier region and said accelerating region; and
(c) a cathodoluminescent screen disposed to one side of said accelerating region, said screen being positioned to receive the electron output of said accelerating region; and
(d) a charge sensing network for sensing the electrical charge striking the cathodoluminescent screen and regulating ion feedback modulating electrodes in response to the charge on said screen.

7. An image display device in accordance with claim 6 in which said ion interaction region is positioned in the volume in said enclosure wherein substantially all of the ions which feed back to said cathode are created.

8. An image display device in accordance with claim 6 in which said means for controlling ion feedback comprises ion feedback modulating electrodes which are disposed in said ion interaction region, at least two of said modulating electrodes being positioned so as to define a path therebetween which is transverse to the direction of ion feedback passing to said cathode.

9. An image display device in accordance with claim 6 in which said means for controlling ion feedback to said cathode comprises ion feedback modulating electrodes which are disposed in said ion interaction region, at least two of said modulating electrodes being disposed in spaced relation so that an electrical field can be provided therebetween.

10. An image display device in accordance with claim 6 which further includes means for modulating an electron flow, said means being disposed to one side of said ion interaction region to receive the electron output therefrom.

11. A method of controlling the output of a device which employs regenerative ion feedback for sustained electron emission, the device including: an enclosure filled with inert gas; a cathode in the enclosure; an electron multiplier region in the enclosure, and a cathodoluminescent screen; the method comprising:

dynamically controlling the magnitude of ion feedback which strikes said cathode so as to determine the feedback loop gain.

12. A method in accordance with claim 11 which includes establishing an electrical field in an ion interaction region which is positioned to receive the electron output of said electron multiplier region.

13. A method in accordance with claim 12 in which said electrical field includes at least two levels, one of which causes the feedback loop gain to be at least unity and the other level causes the feedback loop gain to be less than unity.

14. A method in accordance with claim 13 which includes repeatedly switching between said two levels.

15. A method in accordance with claim 14 in which said switching between said two levels is done in accordance with information supplied by a brightness signal.

16. A method in accordance with claim 15 which includes sensing an electron flow at said cathodoluminescent screen.

17. A method in accordance with claim 15 which includes sensing an electron flow as it passes through said ion interaction region.

18. A method in accordance with claim 13 which includes providing an electrical field in order to modulate the flow of electrons passing from said ion interaction region to said cathodoluminescent screen.

* * * * *